United States Patent [19]

Lejeune

[11] Patent Number: 4,754,618

[45] Date of Patent: Jul. 5, 1988

[54] INSTALLATION FOR SIMULTANEOUSLY DYEING AND FORMING TEXTILE MATERIAL

[75] Inventor: Alfred Lejeune, Tourcoing, France

[73] Assignee: Sarl Texinox, Villeneuve d'Ascq, France

[21] Appl. No.: 887,864

[22] Filed: Jul. 18, 1986

[30] Foreign Application Priority Data

Jun. 2, 1986 [FR] France ..... 86 08243

[51] Int. Cl.[4] ..... D06B 5/22; D06B 23/04

[52] U.S. Cl. ..... 68/5 C; 68/184; 68/199

[58] Field of Search ..... 68/175, 184, 189, 199, 68/5 C

[56] References Cited

U.S. PATENT DOCUMENTS

| | | | |
|---|---|---|---|
| 3,199,752 | 8/1965 | Casse | 68/184 X |
| 3,692,464 | 9/1972 | Furness | 68/189 X |
| 3,864,947 | 2/1975 | Gray | 68/189 X |
| 3,967,923 | 7/1976 | Ameling | 68/189 X |
| 4,543,676 | 10/1985 | Karrer | 68/189 X |

*Primary Examiner*—Philip R. Coe

*Attorney, Agent, or Firm*—Robert E. Burns; Emmanuel J. Lobato

[57] ABSTRACT

A method of treating textile materials and an equipment for carrying out this method are provided, notably for dyeing miscellaneous textile materials or articles, whether woven, knitted or unwoven, of synthetic, artificial or natural origin and of various configurations. The method comprises a sequence of steps consisting in disposing the textile material to be treated on a support matching the configuration of the textile material and having at least one inner cavity in its peripheral area as well as a pervious surface contiguous to the textile material; hot-impregnating the textile material to be treated by using a dyeing solution forced through the material from the back side to the right side thereof at a predetermined temperature, and rinsing the textile material by means of a rinsing liquid forced through the material from the back side to the right side thereof during a predetermined time and at a predetermined temperature.

8 Claims, 3 Drawing Sheets to Distiller
Hot air

INSTALLATION FOR SIMULTANEOUSLY DYEING AND FORMING TEXTILE MATERIAL

BACKGROUND OF THE INVENTION

FIELD OF THE INVENTION

The present invention relates to a method of treating textile materials and also to a treatment equipment for carrying out this method.

The present invention is applicable notably to the dyeing of all kinds of textile materials such as fabric, knitted wears and unwoven materials whether of synthetic, artificial or natural origin, of various configurations. It may be pointed out that in the following disclosure the terms 'textile materials' should be taken in their broadest meaning, such as just described.

As a rule, in the domain of wet treating textile materials, notably for dyeing, several successive steps are required, notably soaping, dyeing, stripping, drying, etc. According to the specific textile materials to be treated and also to their configuration, the present practice consists in carrying out the above-mentioned steps in two known types of equipments: the first and more conventional type comprises an autoclave adapted to be filled with fluid in which the textile material is deposited on suitable supports to facilitate the treatment, the other type of equipment permitting a continuous treatment more suitable for continuously moving webs of textile materials, this treatment being carried out in different in-line or sequential working stations.

In the present state of the art, various dyeing solutions consistent with the particular textile material to be treated and with the treatment process itself are available. As a rule, these dyeing solutions are made from insoluble dyes dispersed by means of a dispersive agent and subsequently carried along by a water stream during the dyeing process proper.

On the other hand, the rinsing liquids are selected by the man of the art as a function of the specific dyestuffs implement.

When carrying out these various methods, the specialist takes care not to damage the textile material and endeavors to obtain a uniform dyeing imparting to the treated material a pleasant appearance and a soft feel. However, as a rule textile materials are dyed before making the end product.

In fact, the treatment applies either to the textile material in its various forms, or to the web of textile material or to the preset finished textile articles, but seldom to finished but non-set textile articles.

However, in such seldom occurrences the products would be made up beforehand by cutting and sewing the various pieces of material according to conventional ready-to-wear production methods.

On the other hand, when the dyeing step is performed at temperatures in excess of 100° C. difficulties arise since the equipment must be so devised that the treatment solution can be brought to such high temperatures without jeopardizing the treatment efficiency. In fact, as a rule the carrier is water and moreover the dispersing agent implemented does not stand well at very high temperatures.

SUMMARY OF THE INVENTION

It is the essential purpose of the present invention to provide an installation for treating textile materials which is applicable notably to the dyeing of textile fabrics, knitted wear and unwoven material, whether of synthetic, artificial or natural origin, and of different configurations, while questioning certain traditional dyeing steps such as eliminating water as a dyestuff vehicle, permitting a rapid dyeing of the textile material to be treated, preserving the appearance and touch properties of the textile material and giving a perfectly uniform tint throughout the material.

It is a primary object of the present invention to provide an installation for treating textile materials which permits of treating woven materials or fabric, knitted wear or unwoven materials, delicate knitted wear, so that the end products be unmarked and has a good unison, while permitting the final shaping of the treated piece or web, thus avoiding costly and time-robbing subsequent operations.

It is another object of the present invention to provide an installation for treating textile materials and an equipment, whereby rolls of textile material having physical properties enabling such rolls to assume a final shape under the action of heat during the hot dyeing step can be dyed without leaving any undesired marks or faults in the finished product.

A further object of the present invention is to provide an instllation for carrying out a continuous method of treating textile materials which departs essentially from the present state of the art in that it comprises an improved step for impregnating and fixing the dyestuff while avoiding the use of vehicles or carriers such as water for accelerating the treatment of webs of woven or knitted textile material.

The present invention is also directed to provide different ways of designing equipments or facilities for the treatment of textile materials so that the method can be carried out either continuously or intermittently, according to the shape and texture of the material to be treated.

Other objects and advantages of the present invention will appear as the following description proceeds with reference to the accompanying drawings illustrating diagrammatically the manner in which the present invention may be carried out in actual practice, the examples illustrated and described herein being given by way of illustration, not of limitation.

According to the present invention, there is provided an installation for carrying out method of treating textile materials, which is applicable more particularly to the dyeing of woven, knitted or unwoven materials, whether of synthetic, artificial or natural origin, or of any desired configuration, and comprises the steps of:

disposing the textile material to be treated on a support matching the configuration of the textile material and having at least one inner cavity in its peripheral area as well as a pervious surface contiguous to the textile material, effecting the hot-impregnation of the textile material to be treated by using a dyeing solution and causing the forced circulation of the dyeing solution through the textile material from the back side to the right side thereof under predetermined time and temperature conditions, and rinsing the textile material with a suitable liquid forced from the back side to the right side thereof, also under predetermined time and temperature conditions.

In this respect, the treatment equipment according to the present invention comprises at least one treatment chamber, means for supplying dyeing and rinsing liquid thereto, conduit means for controlling the direction of flow and the rate of circulation of the various treatment liquids, this equipment being characterised in that it comprises at least:

one support having a shape consistent with the form of the textile material to be treated, this support having at least one inner cavity in its peripheral area and a pervious surface contiguous to the textile material to be treated and adapted to be disposed inside the treatment chamber, and means for causing the forced circulation of the treatment liquids so as to cause said liquids to flow through the textile material from the back side to the right side thereof, more particularly either the dyeing solution or the rinsing liquid.

A clearer understanding of the present invention will be had as the following description proceeds.

THE DRAWINGS

FIG. 1 is a cross-sectional and synoptic view showing an equipment for treating textile materials according to the present invention, notably for dyeing textile pieces or rolls of woven, knitted or unwoven materials, on a form, FIGS. *2a–2c* illustrate another form of embodiment of the equipment for treating textile material according to the invention, notably for dyeing textile rolls, knitted wear or unwoven material on a form, this equipment being similar to the equipment shown in FIG. 1, except that the various steps, namely the impregnation, rinsing and drying, are carried out at successive working stations, and FIG. 3 illustrates an equipment for treating textile materials according to the invention, notably for dyeing webs of woven, knitted or unwoven material.

DESCRIPTION OF THE PREFERRED EMBODIMENT

Figure 1:
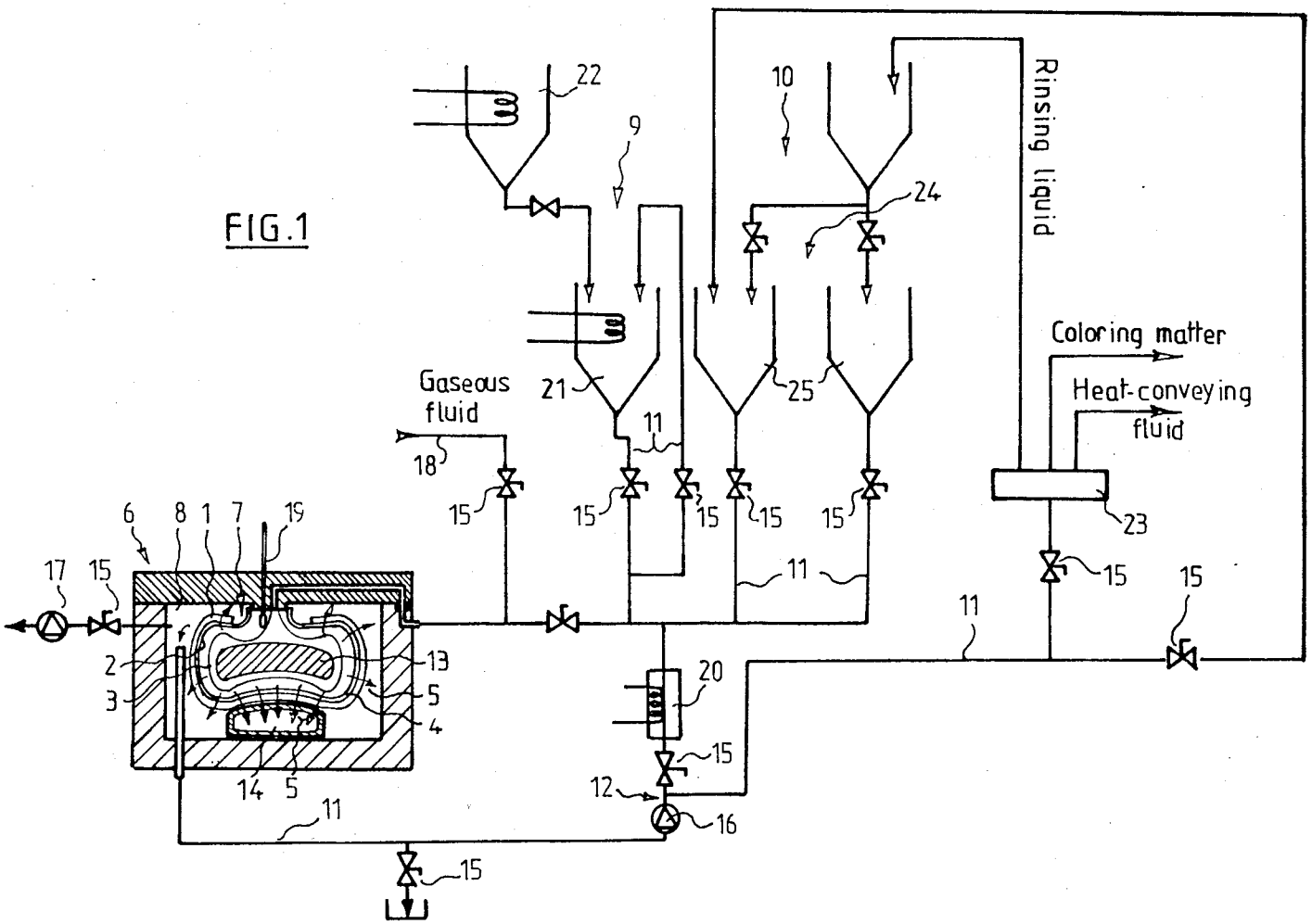
Figures 2A, 2B, 2C:
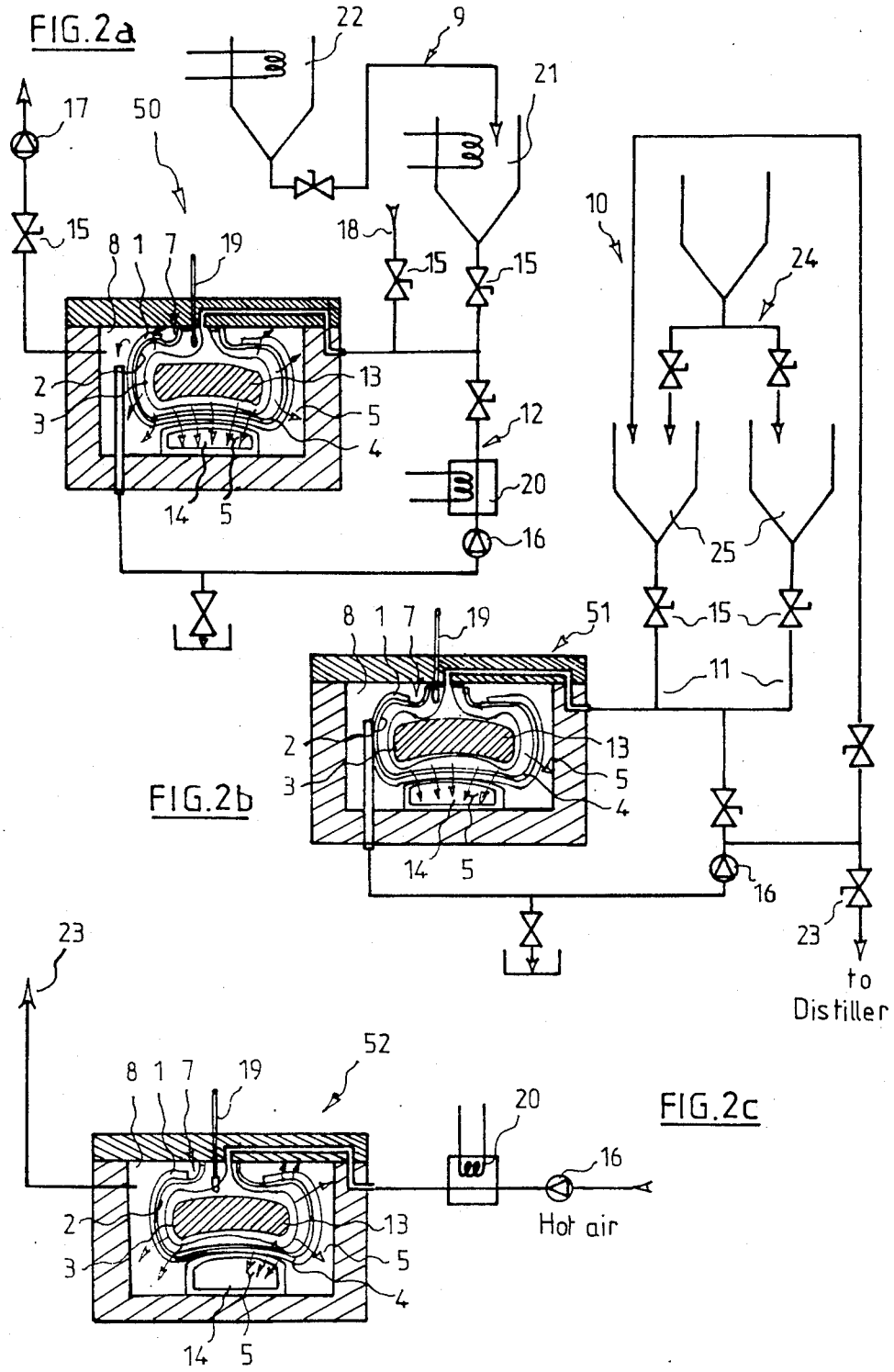

The present invention is directed to provide a method of treating textile materials which is applicable notably to dyeing processes, and more particularly to the two main treatment procedures, namely the continuous process and the batch process.

Though this dyeing treatment has been developed more particularly for treating pieces of synthetic textile material so as to dye and form them definitively without inasmuch impairing the dyeing quality of the material aspect, the treatment method of the present invention is also applicable to any other method type, notably the batch or continuous method, and to all kinds of textile materials, such as woven, knitted or unwoven textile materials of synthetic, artificial or natural origin, whether in bulk or in the form of separate pieces, webs or rolls, which are designated herein by the general term of 'textile material'.

The following main objects for carrying out the dyeing processes of the present invention are as follows: uniformity of the dye thus obtained, absence of marks on or in the treated textile material, preserving the properties of the treated textile material, and a good resistance of the dye to wear and washing. All these objects are obtained sumultaneously by carrying out the method of the present invention.

The treatment method of this invention comprises at least the following sequential steps:

disposing the textile material to be treated on a support 2 having a configuration matching that of the textile material and having at least one internal cavity 3 in its peripheral area as well as a pervious surface 4 contiguous to the textile material 1, hot-impregnating the textile material 1 to be treated with a dyeing solution and forcing this solution through the textile material from the back side to the right side thereof, as shown by the arrows 5 in the drawings, during a predetermined time and at a predetermined temperature, in some specific cases, according to the type of material to be treated or to the desired effects, for example raising the hair of the textile material, the material is gradually cooled, rinsing the thus cooled textile material by means of a rinsing liquid forced through the textile material from the back side to the right side thereof, during a predetermined time and at a predetermined temperature.

On the other hand, to prevent the cooling of the dyeing solution during the impregnation steps, since the impression times are relatively short, the support 2 is preheated and/or the textile material 1 to be treaded is also preheated before impregnating it with the dyeing solution, by using known means and/or delivering a gaseous fluid through the support 2 and/or the textile material 1 to be treated, so that this gaseous fluid will flow through the textile material from the back side to the right side thereof.

Moreover, to improve the efficiency of the process and with due consideration for the thermal inertia of the equipment, the treatment chamber and the conduit system of the equipment are advantageously preheated.

On the other hand, during the impregnation step, the temperature of the dyeing solution circulating through the textile material to be treated is controlled and adjusted continuously.

Furthermore, the dyeing treatment according to the present invention may be improved by cooling the textile material thus treated by causing a gaseous fluid to flow through the material from the back side to the right side thereof, before the rinsing step.

Having thus described the various steps of the treatment method of the present invention, a first form of embodiment of an equipment for carrying out this method will now be described by way of example, with reference to its application to the treatment of textile pieces of woven, knitted or unwoven material, whether of synthetic, artificial or natural origin, and in different configurations. This equipment is illustrated notably in FIG. 1 of the drawings.

With this equipment it is possible notably to treat textile materials with a view to dye on suitable forms pieces of material, knitted wear or unwoven material, of synthetic and/or artificial and/or natural origin, having various possible configurations or shapes.

In fact, in this case, according to the present invention, the support 2 for the textile material 1 to be processed consists of a form 7 matching the configuration of the textile material, and as a textile material 1, a plane piece of material having specific physical properties enabling this piece of material, during the dyeing process, to assume under the action of heat a plastic state and then to retract and resume the configuration of said form 7 during the cooling step. In a typical but non-limiting example of this method, one may contemplate, notably for forming and dyeing covers for seats or the like, its application to pieces of polyester base textile materials such as polyester velvet.

Thus, in a single step the seat cover can be shaped and dyed, and then filled with foam-rubber or like material according to conventional methods well known to the man of the art, for obtaining seat cushions. With this method, the two-step manufacture, including the dyeing step and the actual making step, is avoided, since the complete making steps, consisting in sewing several pieces of pre-cut and dyed material, are definitely eliminated.

In this case, the treatment will advantageously be performed in a closed, heated and fluid-tight chamber 8, in order to obtain some specific advantageous features to be described in detail presently.

Moreover, the equipment 6 comprises means 9 for supplying the dyeing solution, means 10 for supplying the rinsing liquid, and conduit means 11, 12 for the circulation of the various treatment liquids. These component elements are designed and constructed according to well-known and conventional technical methods as will readily occur to those conversant with the art.

On the other hand, according to the present invention, the equipment comprises at least:

a support 2 consistent with the configuration of the textile material 1 to be treated and adapted to be fitted in a chamber 8 also provided with an inner cavity 3 in its peripheral area and a pervious surface 4 contiguous to the textile material, means for causing the forced circulation of the treatment liquids through the textile material 1 from the back side to the front side thereof, as shown by the arrows 5, these liquids being either the dyeing solution or the rinsing liquid.

Moreover, in many cases and according to the particular material to be treated or to the desired final effects, the equipments may comprise means for gradually cooling the temperature of the textile material after the hot impregnation step and before the rinsing step.

More particularly, in the specific case of the treatment equipment shown in FIG. 1, the support 2 consists of a hollow form 7 corresponding to the shape, and also to the necessary holding, of the piece of textile material 1 to be treated. This form has a pervious outer surface so that, when the inner cavity 3 has been filled with the desired treatment liquid, the latter, during its forced circulation, can flow through the external pervious surface of form 7 and then through the textile piece 1 to be treated, from the back side to the right side thereof, as shown by the arrows 5.

Besides, to minimize the volume of treatment liquid circulating in the form 7, the latter may advantageously comprise a core 13. Moreover, the form 7 may also be provided with means for catching the textile material without leaving any trace thereon, for example by using suitable needle or hook means.

According to the specific configuration and nature of the work to be accomplished during the forming step, a counterform 14 may be applied to the form 7 for on the one hand properly holding the piece 1 to be treated and on the other hand making marks or dash lines, for example when it is desired to imitate seams or the like.

The channelling or circulation means 11, 12 consist of conduits adapted to be connected to heating means and to interconnect the various component elements of the equipment, as illustrated in FIG. 1, with the interposition of valve means 15 for switching and establishing forced-circulation circuits by means of a circulation pump 16.

In addition, for carrying out a particular step of the method of the present invention, the equipment 6 comprises means for preheating the support 2 of the textile material and/or other similar material 1, and thus prevent the undesired cooling of the dyeing solution during the impregnation step.

Finally, the equipment comprises suction means for creating a vacuum in chamber 8.

In the example of FIG. 1, the means for preheating the form 7 and/or the piece 1 of material to be treated, together with means for gradually cooling the piece 1, comprise a source of gaseous fluid 18 which, through suitable control means (not shown) permits of filling the chamber 8 with a gaseous fluid and causing this fluid to flow from the back side to the right side of the piece 1 to be treated, this fluid being warm or cold, as required.

The temperature of the fluids may be set by the man of the art as a function of the particular material to be treated and also of the time necessary for preheating and/or cooling the material. The gaseous fluid may consist, according to the cases contemplated, of atmospheric air or neutral gases such as nitrogen or freon.

The suction means 17 consisting essentially of a vacum pump is adapted to vacuumize the inner space of chamber 8 while promoting the circulation of the gaseous fluid through the piece of textile material 1 to be treated in this chamber.

With the above-described devices 18 and 17 and by means of valves 15 and conduits 11, one or the other of the following method steps may be started and controlled before impregnating the piece 1 with a dyeing solution :

vacuum is created in chamber 8 to prevent the oxidation during the dyeing treatment and avoid the development of gas bubbles during the forced circulation of the dyeing solution so as to promote a uniform distribution of the solution through and on the textile material, or the chamber 8 is filled with a neutral gas and this gas is confined therein throughout the impregnation step also for the purpose of preventing the oxidation of the dyeing solution.

Besides, the equipment according to the present invention comprises means 19 for controlling the temperature of the circulating treatment liquid, and other means 20 for heating the liquid. Thus, during the treatment, and more particularly during the impregnation step, the temperature of the dyeing solution is kept at a relatively high level by energizing the heating elements 29 responsive to the temperature measuring device 19 controlling the liquid in the circuit.

Finally, substantial savings may be made as far as the treatment products are concerned, by simply reclaiming the dyeing solution and/or the rinsing liquid from the various steps of the treatment cycle.

The dyeing solution is directed to a feed-tank 21 receiving this solution for example from a supply or master tank 22. Thus, fresh product will be mixed with a slightly spent product in order to keep a predetermined dyestuff supply rate.

In order to permit a proper treatment and purification of the rinsing liquid, the equipment comprises a distillation station 23 for receiving the used rinsing liquid and separating at least the pure rinsing liquid from the dyeing solution. This distillation station 23 is constructed according to the particular chemical nature of the products utilized as a carrier, a coloring matter or a solvent.

In addition, the source of rinsing liquid 24 comprises at least two tanks 25, one tank 25 containing the clean rinsing liquid flowing back for example from the distillation device, the second tank 25 containing the used rinsing liquid.

Thus, one fraction of the rinsing liquid having a low dyestuff content may be used for example in a first or prerinsing step.

It will be seen that the following, non-limiting example gives very good results and permits of determining the various steps of the method performed in an equipment of the type broadly set forth hereinabove with reference to FIG. 1.

The method of the present invention was applied to an initially flat piece of textile polyester material such as polyester velvet.

This piece of textile material was disposed on a form 7 corresponding to the desired final shape of the textile piece to be obtained.

During the step consisting in impregnating the piece of textile material with dyestuff, water-insoluble dyes soluble in a heat-conveying fluid, for example of the diester type, are used.

This vehicle or carrier may consist for example of the product manufactured by the Crucible Chemical Company under the Trademark Cruester 100–X 80WS. The chief advantage offered by this product lies essentially in that it has a very high boiling point, at least higher than 250° C., a high degree of efficiency and a substantial wetting capacity. However, its cost is relatively high and therefore this product must be recovered and regenerated as mentioned in the foregoing.

The dyeing treatment of this polyester velvet textile piece was carried out as follows:

preheating the form 7 and the piece 1 to be treated at a temperature within the range of 180° C. to 200° C. through a hot air circulation from the back side to the right side of the piece, the hot air being introduced through the conduit 18 of the preheating means, creating a vacuum in chamber 8 by means of a vacuum pump 17 for preventing on the one hand the oxidation during the impregnation step and on the other hand the formation of bubbles during the forced circulation of the dyeing solution, then, during the impregnation step, feeding a suitable volume of dyeing fluid previously brought to a temperature of about 180° to 200° C. in tank 21 and subsequently kept permanently at this temperature level throughout the impregnation step by the heating means 20 responsive to the temperature measuring means 19, causing this dyeing solution to circulate under closed-circuit conditions by means of a pump 16 through the piece 1 to be treated, from the back side to the right side thereof, during one to four minutes, delivering the dyeing solution by means of pump 16 back to tank 21, gradually cooling the thus dyed piece of textile material 1 down to a temperature of about 70° C. by either introducing gradually cooled air into conduit 18 or creating a vacuum by means of a suction pump 17, constantly feeding rinsing liquid taken during the rinsing step from tank 24 and then during the final rinsing step from tank 25, causing this rinsing liquid containing perchloroethylene to circulate through conduits 11 and 12 and pump 16 from the back side to the right side of the treated textile material during one minute to four minutes, during the rinsing step, picking up liquid from both tanks 25, the 'clean' liquid being taken from the first tank 25 and recycled to the second 'used' liquid tank 25, these liquid flows being permitted by properly controlling the operation of circulation pump 16 and selectively actuating valves 15 for opening and closing the corresponding conduits 11, finally, keeping the textile piece 1 on its form 7 and gradually drying this piece 1 for example by causing a forced air circulation from the back side to the right side of piece 1, this air being introduced via a conduit 18.

Thus, a uniformly dyed textile piece is obtained, the product being free of any undesired marks and having a pleasant touch, and is ready for any subsequent commercial use without requiring any further conventional manufacturing step.

Although the form of embodiment of the invention described hereinabove and illustrated in FIG. 1 of the drawings comprises only one treatment chamber 8 in which the textile material 1 is subjected to various treatment steps, FIGS. *2a–2c* illustrate a modified form of embodiment wherein the equipment comprises at least three separate chambers 8 each assigned to an essential step of the method of this invention.

This arrangement is advantageous in that it permits of increasing the handling rates which, in conjunction with the proper use of automation means, will reduce appreciably idle periods between successive steps.

FIG. *2a* illustrates a first station 50 in which the step consisting in impregnating the textile material to be treated with the dyeing solution and then, if necessary, the gradual cooling step as disclosed hereinabove, take place.

For this purpose, the equipment will comprise the various essential means already described with reference to FIG. 1 and designated by the same rerefence numerals to facilitate the understanding of the mode of operation.

Then, as shown in FIG. *2b*, the equipment comprises a station 51 consisting essentially of a fluid-tight chamber 8 of the same type as chamber 8 of FIG. 1 but so connected and arranged as to be capable of performing the rinsing step of the method of the instant invention as described in the foregoing.

Finally, FIG. *2c* shows a drying station 52 also comprising a fluid-tight chamber 8 of same type as the two chambers 8 of FIGS. *2a* and *2b*, but arranged to permit the circulation of a gaseous fluid from the back side to the right side of the treated textile material so as to gradually dry this material. This drying step is performed for example by injecting air of which the temperature is gradually lowered.

On the other hand, it will be seen that these various stations 50–52 are connected to the circuit supplying dyeing fluid and rinsing liquid and comprise a distillation station of the same type as the one already described with reference to the arrangement of FIG. 1.

Figure 3:
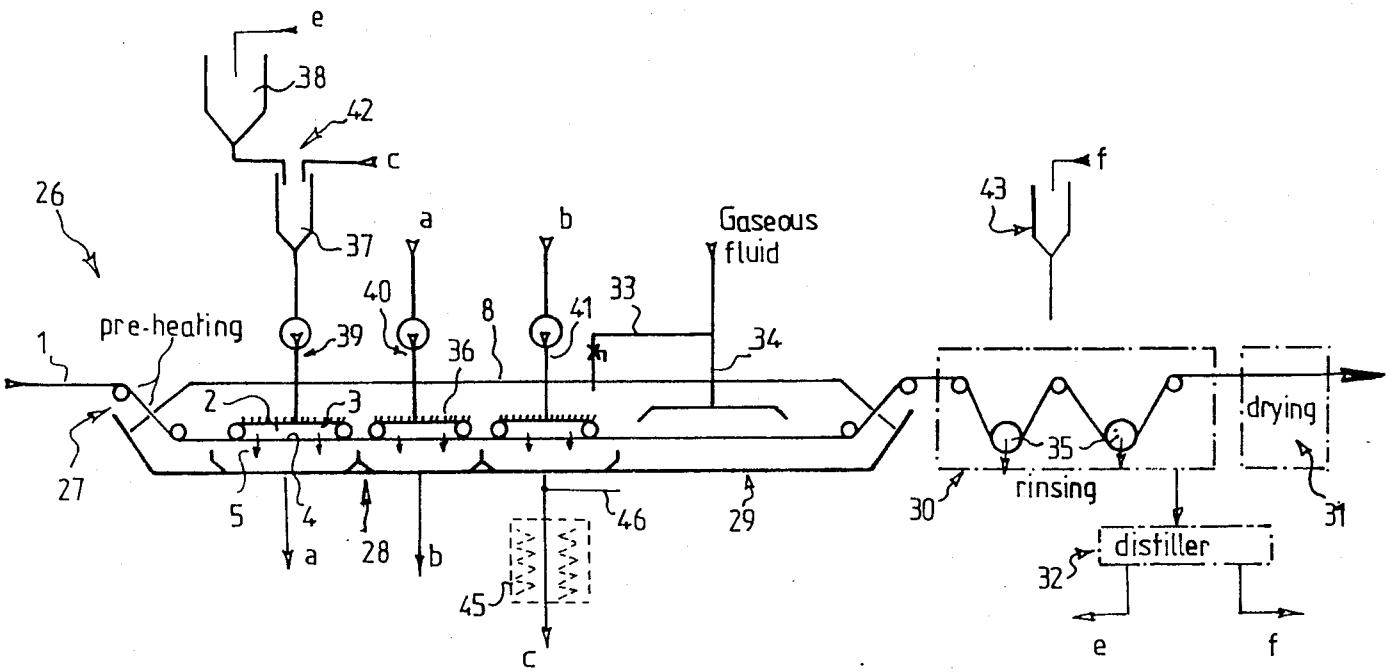

FIG. 3 illustrates a treatment equipment permitting of carrying out the dyeing treatment method described hereinabove but operating as a continuous process forr treating a web of textile material which may be woven, knitted or unwoven, of synthetic and/or artificial and/or natural origin. This equipment comprises a proper sequence of the various stations necessary for carrying out the various treatment steps.

More particularly, the continuous treatment equipment 26 comprises the following sequence of working stations:

a preheating station 27 in which the temperature of the support 2 carrying the web 1 to be treated and/or the web 1 preliminary to the hot-impregnation step with the dyeing solution is raised, by delivering a gaseous fluid through said support 2 and/or said web 1 from the back side to the right side of the web to be treated, a station 28 for impregnating the textile material with the dyeing solution, the web being hot-impregnated by forcing the circulation of dyestuff solution through the web 1 to be treated from the back side to the right side thereof under predetermined time and temperature conditions;

a cooling station 29 in which the temperature of the thus dyed web is gradually lowered, a rinsing station 30 in which the excess dyeing solution not fixed to the textile material is eliminated by means of a rinsing liquid of which the circulation through the web 1 from the back side to the right side thereof is forced under predetermined time and temperature conditions, a station 31 in which the thus treated web is dried, and a distillation station for separating and recovering on the one hand the coloring matter and on the other hand the clean rinsing liquid in order to recycle them in the equipment.

In contrast to the form of embodiment shown in FIG. l, in the equipment of FIG. 3 the solution will impregnate the web 1 in a closed yet pervious chamber 8, thus excluding the use of vacuum means. To palliate this inconvenience and prevent the oxidation of the dyeing solution during the impregnation step, the treatment chamber 8 is filled with a neutral gas, for example through a conduit 33, and this neutral gas supply is maintained throughout the impregnation step. On the other hand, during the gradual cooling phase, a jet of gradually cooled air is directed into this treatment chamber 8 via another conduit 34.

As far as the rinsing and drying stations are concerned, these are designed in conformity with the structures known to the man of the art in the domain of continuous treatment. However, it may be noted that during the rinsing step devices capable of forcing the rinsing liquid from the back side to the right side of the web, as illustrated notably by the arrows 5, are used.

As to the supply of rinsing liquid from a tank 43 and the distillation station 32, the construction is similar to that of the above-described equipments and a selective rinsing is accomplished firstly with a rinsing product already loaded with dyeing solution and eventually with a clean or purified rinsing product.

On the other hand, the support 2 of the web 1 to be treated is carried by a flat conveyor 36 driven continuously and adapted to lead the web 1 through the chamber 8.

As in the preceding form of embodiment, the web support, in this case the flat conveyor 36, comprises an inner cavity 3 and a pervious surface 4 contiguous to the web 1 and provided with catch means for holding the web during its passage through chamber 8.

To permit the method of the present invention to be carried out in the impregnation phase and also to permit the recovery of the dyeing solution, the continuous treatment equipment 28 will advantageously comprise within the treatment chamber 8 a plurality of serially disposed conveyors 36 for improving the treatment efficiency and cause the dyeing solution to flow through the web from the back side to the right side thereof under predetermined temperature and time conditions.

More particularly, as shown in FIG. 3, the equipment will comprise a feed system 42 for supplying dyeing solution, which comprises an intermediate or slave tank 37 receiving the solution from a master tank 38, a conduit system and circulation means 39–41, means for heating the dyeing solution causing the forced circulation of the solution sequentially which are responsive to temperature control means 46 for through the web, as shown in FIG. 3 by the arrows 5, along the path followed by the web undergoing the treatment, these various means being disposed in proper sequence to promote the uniformity of the web dyeing operation.

The number of conveyors 36 can be easily determined by anybody skilled in the art and will depend notably on the textile nature of the web to be treated, on the rate of travel of the web and on the required impregnation time.

Of course, other forms of embodiment of the invention will readily occur to those conversant with the art, and various modifications and changes may be brought to the forms of embodiment shown and illustrated herein without departing from the basic principles of the invention.

What is claimed is:

1. Installation for dyeing initially plane pieces of textile material and simultaneously heat-forming said pieces of textile material to a three-dimensional formed configuration, said installation comprising, at least one closed treatment enclosure, a support element disposed in said treatment enclosure, said support element having a contoured permeable exterior surface conforming to the formed configuration of said piece of textile material and an internal cavity, means for maintaining said piece of textile material on said support element so as to be applied on said contoured permeable surface of said support element, means for feeding hot dyeing liquid to said internal cavity of said support element at a temperature high enough to dye said textile material and to set said textile material to the configuration of said exterior surface, means for feeding rinsing liquid to said internal cavity of said support element after dyeing and setting said piece of textile material, conduit means connecting said cavity with the interior of said treatment enclosure to provide a recirculation path, means in said recirculation path for forcing liquid through said recirculation path from the interior of said treatment enclosure to said cavity, means for sensing the temperature of liquid in the interior of said treatment enclosure, and means in said recirculation path external of said treatment enclosure and controlled by said sensing means for maintaining the temperature of circulated liquid at a predetermined value.

2. Installation according to claim 1, further comprising means for supplying to said cavity of said support element a gaseous fluid for progressively cooling the piece of textile material after dyeing and setting said piece of textile material and before rinsing said piece of textile material.

3. Installation according to claim 1, further comprising means for supplying temperature controlled gaseous fluid to said cavity of said support element for controlling the temperature of said support element and said textile material thereon.

4. Installation according to claim 1, further comprising means for evacuating the interior of said treatment enclosured.

5. Installation according to claim 1, further comprising means for supplying a gaseous fluid to fill the interior of said treatment enclosure with a neutral gas.

6. Installation according to claim 1, further comprising a core disposed in said internal cavity and reducing the volume of said cavity.

7. Installation awarding to claim 1 further comprising means, connected with said recirculation path, for separating rinsing liquid from dyeing liquid.

8. Installation according to claim 1 in which said means for means for maintainig said piece of textile material on said support element comprises a counterform for pressing said piece of textile material against said contoured permeable exterior surface of said support element.

* * * * *